US005503120A

United States Patent [19]

Shirey et al.

[11] Patent Number: 5,503,120

[45] Date of Patent: Apr. 2, 1996

[54] ENGINE VALVE TIMING CONTROL SYSTEM AND METHOD

[75] Inventors: Benjamin G. Shirey, Farmington Hills; Mark R. Molitor, Muskegon, both of Mich.

[73] Assignee: Siemens Automotive Corporation, Auburn Hills, Mich.

[21] Appl. No.: 374,014

[22] Filed: Jan. 18, 1995

[51] Int. Cl.[6] ..... F01L 9/02; F01L 13/00

[52] U.S. Cl. ..... 123/90.12; 123/90.16; 123/90.17; 123/90.6

[58] Field of Search ..... 123/90.12, 90.13, 123/90.15, 90.16, 90.17, 90.48, 90.49, 90.5, 90.55, 90.6

[56] References Cited

U.S. PATENT DOCUMENTS

| | | | |
|---|---|---|---|
| 4,538,559 | 9/1985 | Imamura et al. | 123/90.6 |
| 4,615,306 | 10/1986 | Wakeman | 123/90.16 |
| 4,878,462 | 11/1989 | Kurisu et al. | 123/90.6 |
| 5,002,022 | 3/1991 | Perr | 123/90.12 |
| 5,088,458 | 2/1992 | Wakeman et al. | 123/90.49 |
| 5,154,143 | 10/1992 | Stutzenberger | 123/90.16 |
| 5,158,048 | 10/1992 | Robnett et al. | 123/90.16 |
| 5,216,988 | 6/1993 | Taxon | 123/90.12 |
| 5,255,639 | 10/1993 | Shirey et al. | 123/90.12 |

*Primary Examiner*—Weilun Lo
*Attorney, Agent, or Firm*—Russel C. Wells

[57] ABSTRACT

A simplified lost motion valve control system and method for engines combines a cam, having a seating ramp located between lift and return profiles of the cam lobe, with a simplified hydraulic actuator having follower and actuator pistons and a fluid discharge passage that is internally cut off by the actuator piston when the valve is close to its seated position. After opening of the valve by the cam through the actuator to a desired valve opening, the valve is closed by opening a solenoid valve to discharge fluid from the actuator until the valve closes to near its seated position. The valve is then seated by the actuator following the cam seating ramp. The actuator is refilled upon return of the follower piston along the cam return profile to the base circle. Exemplary embodiments of hydraulic actuators are disclosed as is a system including control of dual actuators, driven by out of phase cams, through a single solenoid valve alternately isolated by the discharge port closure of the actuator pistons.

9 Claims, 2 Drawing Sheets

ENGINE VALVE TIMING CONTROL SYSTEM AND METHOD

FIELD OF THE INVENTION

This invention relates to engine valve timing control systems and to methods of valve timing control.

BACKGROUND OF THE INVENTION

It is known in the art to provide for control of engine valve lift and timing using a preferably electronic control actuating a solenoid valve to control discharge of fluid from one or more lost motion hydraulic valve actuators driven by an engine camshaft. One such valve timing control system is shown, for example, in the U.S. Pat. No. 4,615,306 Wakeman issued Oct. 7, 1986.

In order to provide soft seating of the engine valves, lost motion actuators for use in such systems have been provided with means for damping the valve seating action as described, for example, in U.S. Pat. Nos. 5,158,048 Robnett issued Oct. 27, 1992, and 5,216,988 Taxon issued Jun. 8, 1993.

SUMMARY OF THE INVENTION

The present invention provides simplified lost motion actuator arrangements as well as a system and method of valve timing control which eliminates the need for hydraulic damping in the actuator and allows seating of the valve to be controlled by a preferably constant velocity seating ramp formed on the actuating cam. The method involves discharging hydraulic fluid from the actuator at any time up to about the peak of the cam lift curve followed by hydraulic closing of the valve until it contacts the seating ramp near the valve closed position. At this point, fluid discharge is cut off and the valve is seated by the actuator moving along the valve seating ramp. A system including control of multiple actuators by a single solenoid valve without the use of intermediate check valves is also provided, as are various embodiments of simplified hydraulic actuators.

These and other features and advantages of the invention will be more fully understood from the following description of certain exemplary embodiments of the invention taken together with the accompanying drawings.

DETAILED DESCRIPTION OF THE INVENTION

Figure 1:
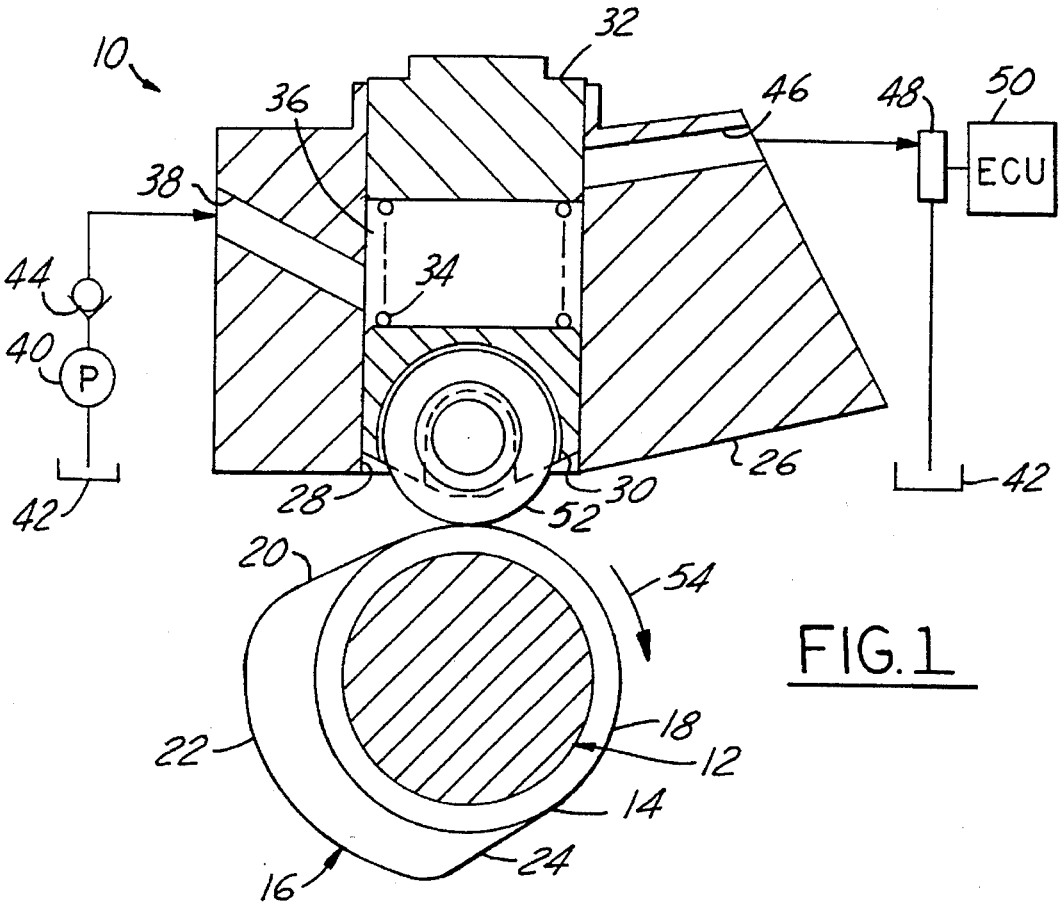
FIG. 1 is a fragmentary cross-sectional view, partially schematic, of an engine valve timing control system according to the invention.

Referring first to FIG. 1 of the drawings in detail, numeral 10 generally indicates an engine having a first embodiment of valve timing control system according to the invention. Engine 10 rotatably carries a camshaft 12 having a cam 14 including a lobe 16 extending outward from the base circle 18 of the cam. The lobe 16 includes a lift profile 20, a valve seating ramp 22, and a return profile 24 to be subsequently more fully discussed.

Above the camshaft 12, the engine further includes a cylinder head valve gallery 26 including several bores 28 only one of which is shown. The valve gallery 26 acts as the housing for a valve actuator in each bore, each actuator including a follower piston 30 and an actuator piston 32. The pistons are axially aligned and reciprocably mounted within their respective bore 28 and are biased apart by a spring 34. Between the pistons there is defined an enclosed fluid chamber 36. Chamber 36 is filled with hydraulic fluid (generally engine oil) through a fill port 38 supplied by a pump 40 from a sump 42 through a check valve 44 that prevents reverse flow from the fill port 38. A drain port 46 also intersects the bore 28 and is connected externally with a solenoid valve 48 controlled by an electronic control unit (ECU) 50 and having an outlet connected with the sump 42.

Actuator piston 32 connects, through means such as a rocker arm not shown, with an engine valve, not shown, for actuating the valve in conventional fashion through reciprocation of the actuator piston 32 in the bore 28. In FIG. 1, piston 32 is shown in the position in which the engine valve is fully seated. In this position, the piston 32 closes the drain port 46 and prevents the escape of hydraulic fluid from the chamber 36 through the port 46.

The follower piston 30, in the embodiment shown, carries a follower roller 52 which engages the cam 14 for imparting the motion thereof to the follower piston.

Figure 2:
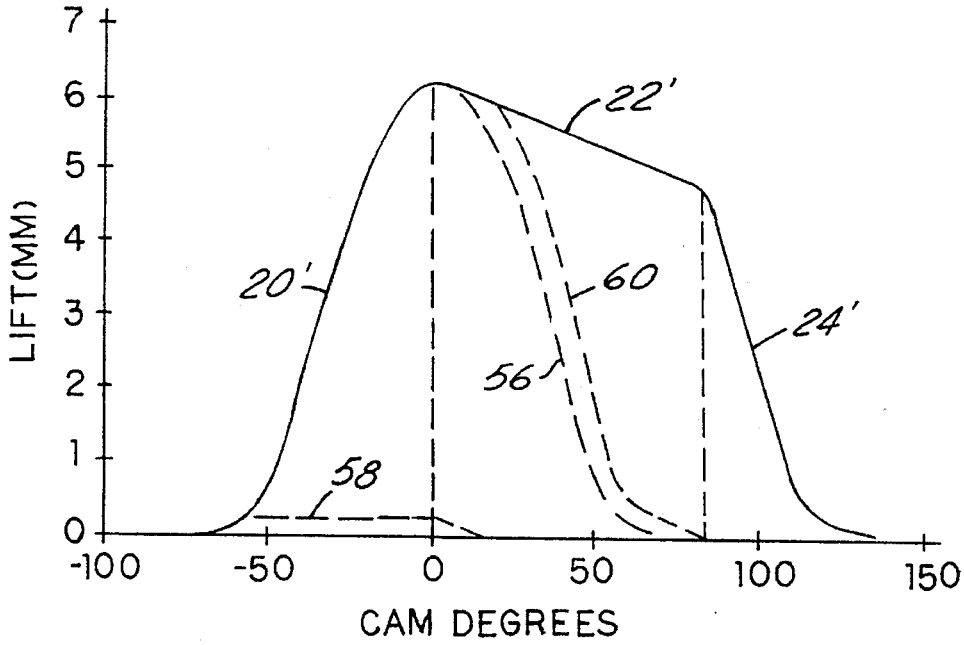
FIG. 2 is an exemplary cam profile diagram for a cam according to the invention.

FIG. 2 illustrates diagrammatically the motion of the roller follower piston 30 when actuated by the lobe 16 of the cam as it is rotated in a clockwise direction as shown by the arrow 54 in FIG. 1. As the cam lift profile 20 engages the roller 52, the piston 30 is raised along the lift curve 20' of FIG. 2 to the highest point on the lift curve shown at 0° in FIG. 2. Thereafter the piston 30 is lowered slowly by the valve seating ramp 22 along the curve 22' of FIG. 2, which represents a constant velocity seating ramp having a constant slope. At the end of the ramp 22, the roller reaches the cam return profile 24 which lowers the piston 30 along the curve 24' back to the base circle 18 indicated by the zero lift line. A dashed line 56 indicates the return profile of a conventional cam for returning the cam follower to the base circle 18. A second dashed line 58 illustrates the minimum valve opening and earliest closing of the valve, and a third dashed line 60 represents the maximum valve opening and latest closing of the valve.

In operation, when the solenoid valve 48 is closed and the camshaft is rotating clockwise, the fluid chamber 36 is filled with fluid by the pump 40 when the follower piston 30 is riding on the base circle 18 of the cam. As the lobe 16 reaches the follower, roller 52 forces the piston 30 to move along the line 20', 22', and 24' of FIG. 2. Since the fluid in chamber 36 cannot escape when the solenoid valve is closed, the actuator piston 32 is also raised along the lift profile 20' to the maximum lift point at zero cam degrees. Shortly after this point, or prior thereto, the ECU 50 opens the solenoid valve 48, allowing fluid in the chamber 36 to escape through the drain port 46 to the sump 42. During this action, the conventional valve spring, not shown, closes the engine valve at a rate permitted by the discharge of fluid through the drain port 46 and solenoid valve 48, a rate shown, for example, by the dashed line 60 of FIG. 2.

When the actuator piston 32 moves downward near to the point of valve seating, the piston 32 closes drain port 46 so that further discharge of fluid through the port is cut off. Thereafter, when the follower roller 52 is riding down the, preferably constant, slope of the seating ramp 22 of the cam lobe, the valve is closed slowly by the downward motion of the follower piston 30 which is equaled by motion of the actuator piston 32, moving the valve to the fully seated position at a rate determined by the slope of seating ramp 22 of the cam. After the valve is seated, subsequent downward movement of the follower piston 30 along the ramp 22 and the return profile 24 to the base circle 18 allows refilling of the chamber 36 with fluid through the fill port 38 in preparation for the next valve actuating event.

Figure 3:
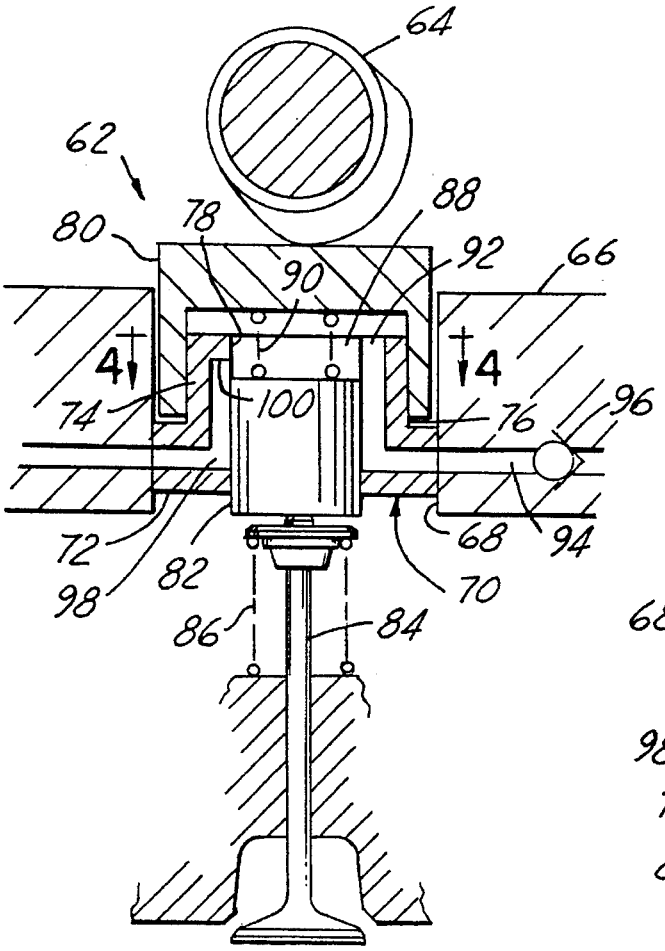
FIG. 3 is a cross-sectional view of an alternative embodiment of a valve timing control system in an overhead cam engine.
Figure 4:
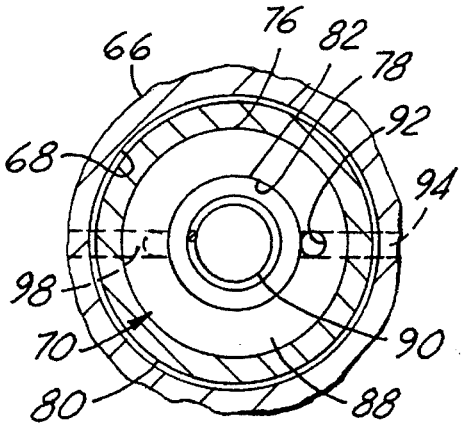
FIG. 4 is a cross-sectional view downward from the line 4—4 of FIG. 3.

FIGS. 3 and 4 of the drawings illustrate an alternative embodiment of lost motion actuator and valve timing control which functions generally in a manner similar to the embodiment previously described but is arranged primarily for overhead cam engines. In this embodiment, the engine 62 carries an overhead camshaft having a cam 64 similar to cam 14 of the first described embodiment. Below the cam 64, a camshaft lifter gallery 66 of an engine cylinder head includes a bore 68 in which is mounted a cylindrical actuator housing 70. The housing 70 includes an annular rim 72 fixedly secured in the bore 68 and a reduced diameter cylinder portion 74 extending upwardly from the rim and having external and internal cylinder surfaces 76, 78, respectively. The internal surface 78 extends through the rim so that it is open on both the upper and lower ends.

A follower piston 80 is reciprocably mounted upon the external cylindrical surface 76 and extends thereabove into engagement with the cam 64. An actuator piston 82 is reciprocably received within the internal cylindrical surface 78 and directly engages a valve 84 of the engine which is conventionally urged in a seating direction by a valve spring 86. Between the pistons 80, 82, there is formed a fluid chamber 88. A spring 90 in the chamber acts against the pistons 80, 82 and urges them against the cam and the valve respectively. A fill passage 92 in the actuator housing connects at all times with the chamber 88 and with an oil supply line 94 in the lifter gallery 66 through which engine oil pressure is supplied through a check valve 96 to the chamber 88. Housing 70 also includes a drain passage 98 that connects through the lifter gallery with a solenoid valve, not shown, and extends inward to the internal surface 78 and upwardly therein to an end point 100 located below the upper end of the internal surface 78 of the associated cylinder portion 74.

Operation of this embodiment (FIGS. 3, 4) of the invention is similar to that previously described with certain exceptions. Since the follower piston 80 has a larger internal diameter exposed to chamber 88 than does the actuator piston 82, the motion of the follower piston 80 is multiplied by the area ratio to increase the follower piston motion. Thus the lift of the cam lobe on cam 64 may be made smaller than in the first described embodiment where no multiplication ratio of cam motion is present. This provides for a more compact cam and actuator structure which is of particular importance in overhead cam engines but may be desirable in other applications as well.

As shown in FIG. 3, the cam is in the process of opening the partially open valve 84. When the solenoid valve, not shown, is open, oil is drained from the chamber 88 through passage 98, allowing the valve to move toward closing until the actuator piston 82 rises to the end point 100 where flow through the passage 98 is cut off. Thereafter, as in the previous embodiment, the valve moves the remaining small amount to its closed position under control of the constant velocity seating ramp of the cam 64 so that valve seating motion is controlled directly by the cam through the actuator pistons 80, 82 with the hydraulic chamber 88 acting as a solid link.

Although the form of the structure shown in FIGS. 3 and 4 is such as to mount the piston 80 on the external surface 76 of housing 70, it should be recognized that the piston 80 could be arranged to reciprocate in sealing engagement with the bore 68 instead of the housing surface 76. In such a case, lifter gallery 66 would form, in effect, a portion of the housing of the actuator including the two pistons 80, 82. However, the chamber 88 would be expanded to the diameter of the bore 68 and the area of the upper piston against the chamber would be accordingly increased.

Figure 5:
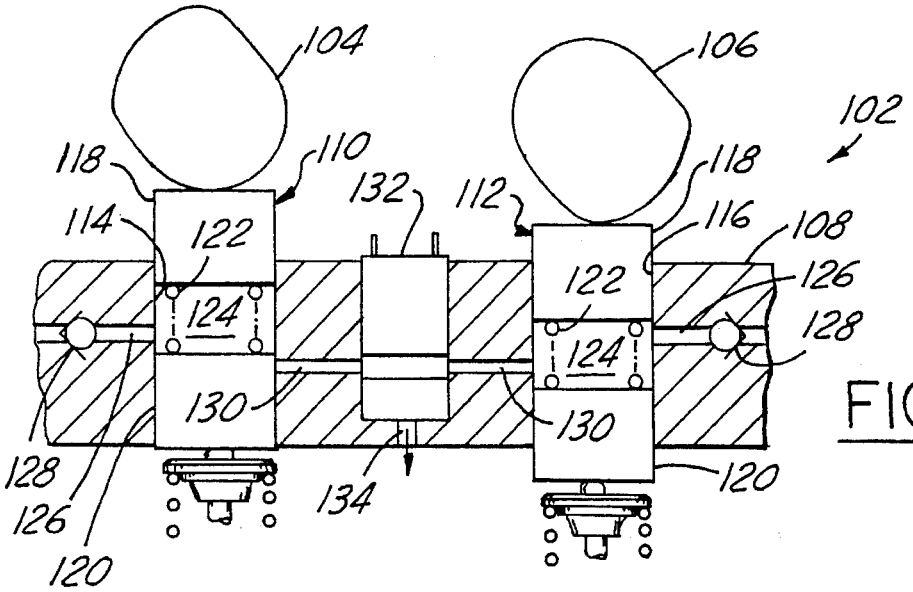
FIG. 5 is a cross-sectional view of a valve timing control system according to the invention using a shared solenoid valve.

Referring now to FIG. 5 of the drawings, there is shown a novel embodiment of valve timing control system wherein a single solenoid valve is used to control the valve actuating performance of two actuators. In this embodiment, the engine 102 includes a camshaft having a pair of cams 104, 106 configured similarly to cam 14 of FIG. 1 and having their lobes positioned one half cycle, or 180°, out of phase. Below the cams, a lifter gallery 108 forms a housing for a pair of valve actuators 110 and 112 operating in internal bores 114 and 116, respectively, of the lifter gallery. Each of the actuators 110, 112 includes a follower piston 118 engaging its respective cam 104, 106 and an actuator piston 120 operatively engaging a valve, not shown, of the engine. The pistons are biased apart by springs 122 and define a fluid chamber 124 between them, each chamber being supplied with fluid through fill passages 126 provided with inlet check valves 128. Drain ports 130 connect the fluid chambers 124 with a single solenoid valve 132. Valve 132 is externally controlled, as by an ECU not shown, and includes an outlet passage 134 for returning discharged oil to the engine sump, not shown.

The drain ports 130 are positioned to open into their respective chamber 124 only when the engine valve has been opened slightly beyond its seated position by motion of piston 120 downwardly from the valve closed position in which actuator 110 is shown in FIG. 5 toward the valve open position in which actuator 112 is shown in FIG. 5. Since the cams 104, 106 are timed out of phase, at least one of the engine valves driven by the cams is closed at all times. Thus, it is apparent that one of the drain ports 130 is always closed. For example, port 130 from actuator 110 is shown closed in FIG. 5 while the corresponding port 130 to actuator 112 is open, since the valve driven by cam 106 is in the open position. Because of this alternate opening of the drain ports 130, the single solenoid valve 132 may be utilized to control both actuators 110 and 112. Opening of the solenoid valve will be effective to drain fluid from only the actuator which is in a valve open position. Concurrently, the other actuator chamber is cut off from the effects of fluid flow out of the operative chamber by reason of closure of the drain port 130 by the piston 120 of the closed valve actuator. In this way, any pressure pulses which may be present from discharging fluid from one of the actuators are prevented from affecting the other actuator due to the closing of its drain port.

While the invention has been described by reference to various specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A method of engine valve timing control characterized by:

actuating a valve open by a rotating cam acting through a fluid containing actuator;

partially closing the valve to near its seating point by discharging fluid through selectively timed fluid discharge means that is closed internally by the actuator when the valve is at a predetermined valve position near to valve seating;

seating the valve by a valve seating ramp on the cam acting through the actuator after closing of the discharge means at said predetermined valve position;

subsequently returning the cam to a base circle position; and refilling the actuator with fluid in preparation for a subsequent valve actuation event.

2. A method as in claim 1 characterized in that:

said valve seating step is carried out at a predetermined rate at an interval along the length of the valve seating ramp by providing the valve seating ramp with a constant slope.

3. A method as in claim 1 wherein a second valve is actuatable by a second cam timed through a second actuator equivalent to the first actuator, the second cam being timed out of phase with the first cam for actuating the valves during different phase intervals, the method being further characterized by:

repeating, with respect to the second valve, cam and actuator the prior steps of actuating the valve, partially closing the valve, seating the valve, returning the cam to a base circle position and refilling the actuator; and controlling the selective timing of said discharge means of both actuators through a common discharge valve, whereby the internal closing of the actuators during valve seating prevents cross communication of discharge pressure pulses between the actuators.

4. An engine valve timing control system characterized by:

an engine driven cam including a lobe having a lift profile extending to a peak, a return profile spaced from the peak, and a valve seating ramp extending between the peak and the return profile;

an actuator including a housing, a follower piston and an actuator piston, both pistons reciprocably carried by said housing and defining therewith a fluid chamber between the pistons, and biasing means urging the follower piston into operative contact with the cam for actuation by the lobe and urging the actuator piston into operative contact with an engine valve for actuating the valve;

fluid supply means for supplying hydraulic fluid to the chamber;

fluid discharge means for selectively allowing discharge of fluid from the chamber when the follower piston is actuated by the lobe, said discharge means including a discharge port that is closed by the actuating piston prior to seating of the valve to cut off fluid discharge during valve seating; and control means operative to open the fluid discharge means to allow fluid discharge from the chamber during each cam cycle at a selected point prior to termination of follower piston actuation by the valve seating ramp so that valve seating is controlled by the ramp after the discharge port is closed by the actuating piston.

5. An engine valve timing control system as in claim 4 characterized in that:

said actuator piston carries a roller which engages the cam for rolling contact therewith.

6. An engine valve timing control system as in claim 5 characterized in that:

said pistons are axially aligned and reciprocable in a common cylinder.

7. An engine valve timing control system as in claim 4 characterized in that:

said follower piston has a larger effective area than said actuator piston.

8. An engine valve timing control system as in claim 7 characterized in that:

said housing defines a cylinder reciprocably receiving said actuator piston, said port of the fluid discharge means opening into said cylinder.

9. An engine valve timing control system characterized by:

a pair of engine driven cams each including a lobe having a lift profile extending to a peak, a return profile spaced from the peak, and a valve seating ramp extending between the peak and the return profile, said cams being timed for out of phase for non-overlapping actuation of separate valves;

an actuator associated with each of said cams and including a housing, a follower piston and an actuator piston, both pistons reciprocably carried by said housing and defining therewith a fluid chamber between the pistons, and biasing means urging the follower piston into operative contact with its respective cam for actuation by the lobe and urging the actuator piston into operative contact with an engine valve for actuating the valve;

fluid supply means for supplying hydraulic fluid to the chambers of said actuators;

fluid discharge means for selectively allowing discharge of fluid from said chambers when their respective follower pistons are actuated by the associated lobes, said discharge means including a discharge port in each actuator that is closed by the associated actuating piston prior to seating of the corresponding valve to cut off fluid discharge during valve seating and when the valve is closed, and a single control valve directly connected to both said discharge ports for receiving fluid therefrom when their respective valves are open; and control means operative to open said control valve to allow discharge of fluid from each chamber during each cam cycle at selected points prior to termination of follower piston actuation by the associated valve seating ramp so that valve seating is controlled by the respective ramp after the respective discharge port is closed by the associated actuating piston.

* * * * *